United States Patent [19]

Stone

[11] 4,438,849

[45] Mar. 27, 1984

[54] PACKAGE FOR PROTECTING A GENERALLY RECTANGULAR PARALLELPIPED ARTICLE

[75] Inventor: Orison W. Stone, Middlebury, Vt.

[73] Assignee: Pack Image, Inc., Middlebury, Vt.

[21] Appl. No.: 324,035

[22] Filed: Nov. 23, 1981

[51] Int. Cl.[3] ..... B65D 81/02

[52] U.S. Cl. ..... 206/592; 220/411; 220/446

[58] Field of Search ..... 206/320, 521, 591, 592, 206/593, 594; 220/410, 441, 460, 462, 463, 94 R, 446, 411; 229/5.5, 90

[56] References Cited

U.S. PATENT DOCUMENTS

| | | | |
|---|---|---|---|
| 1,522,902 | 1/1925 | Oppenheim | 206/594 |
| 1,560,092 | 11/1925 | Odquist | 220/94 R |
| 1,719,398 | 7/1929 | Fields | 220/94 R |
| 1,728,894 | 9/1929 | Oppenheim | 206/594 |
| 1,929,433 | 10/1933 | Kenny | 220/94 R |
| 2,013,346 | 9/1935 | Gomes | 206/320 |
| 2,330,347 | 9/1943 | Elliot | 206/591 |
| 2,624,989 | 1/1953 | White | 229/90 |
| 2,995,288 | 8/1961 | Jesinghaus | 206/594 |
| 3,056,536 | 10/1962 | Smith et al. | 206/521 |
| 3,240,417 | 3/1966 | Andreini | 206/592 |

*Primary Examiner*—George E. Lowrance
*Assistant Examiner*—Jimmy G. Foster
*Attorney, Agent, or Firm*—Wood, Herron & Evans

[57] ABSTRACT

A package having four component parts for protecting generally rectangular parallelpiped articles. This package comprises an inner liner or collar unit, an outer carton and two reinforcing ribs or fillers. The inner liner encircles the article being protected and includes upper and lower reinforcing rims or flanges which lie above and below the protected article. Two reinforcing ribs are positioned within the inner shell adjacent each of the reinforcing flanges in contact with the top and bottom of the article being protected. This assembly is then placed into the outer carton or container. The container is simply a rectangular box which corresponds in size to the size of the inner liner and which holds the component parts of the package together in contact with the rectangular parallelpiped article being protected.

10 Claims, 4 Drawing Figures

PACKAGE FOR PROTECTING A GENERALLY RECTANGULAR PARALLELPIPED ARTICLE

The present invention relates to a package and, more specifically, to a package designed to provide structural strength and support to a rectangular parallelpiped metal can as will appear, the package with modifications can be used for cylindrical cans.

Syrup and other viscous fluids are frequently stored and shipped in rectangular, parallelpiped metal cans. This viscous material acts severely on the can, particularly when it is being shipped. In order to prevent the rupture of these cans and to prevent leakage during shipment or storage, it is necessary to provide added protection. This has been accomplished in the past by encasing the cans in a paperboard box. These boxes have included inner reinforcing shells or sleeves, but have failed to provide adequate protections for the cans.

Accordingly, it is the object of the present invention to provide an outer protective package for rectangular metallic containers. More specifically, it is the object of the present invention to provide a paperboard or cardboard package which provides additional wall strength for a metal can filled with viscous fluid, thereby enabling the material to be shipped safely without risk of rupturing the metal can.

These objects are attained by a novel four-piece protective package which includes an inner liner having upper and lower flanges, an upper and a lower reinforcing rib, and an outer package. The inner liner wraps around a metal can with the upper and lower flanges abutting the upper and lower chimes of the can. The reinforcing ribs fit against the top and bottom of the can alongside the flanges. The can, together with the liner and ribs, fit snuggly within the outer carton. In this assembled form, the top and bottom of the can are prevented from buckling and the entire can is protected from the hazards of shipping.

DETAILED DESCRIPTION

Figure 1:
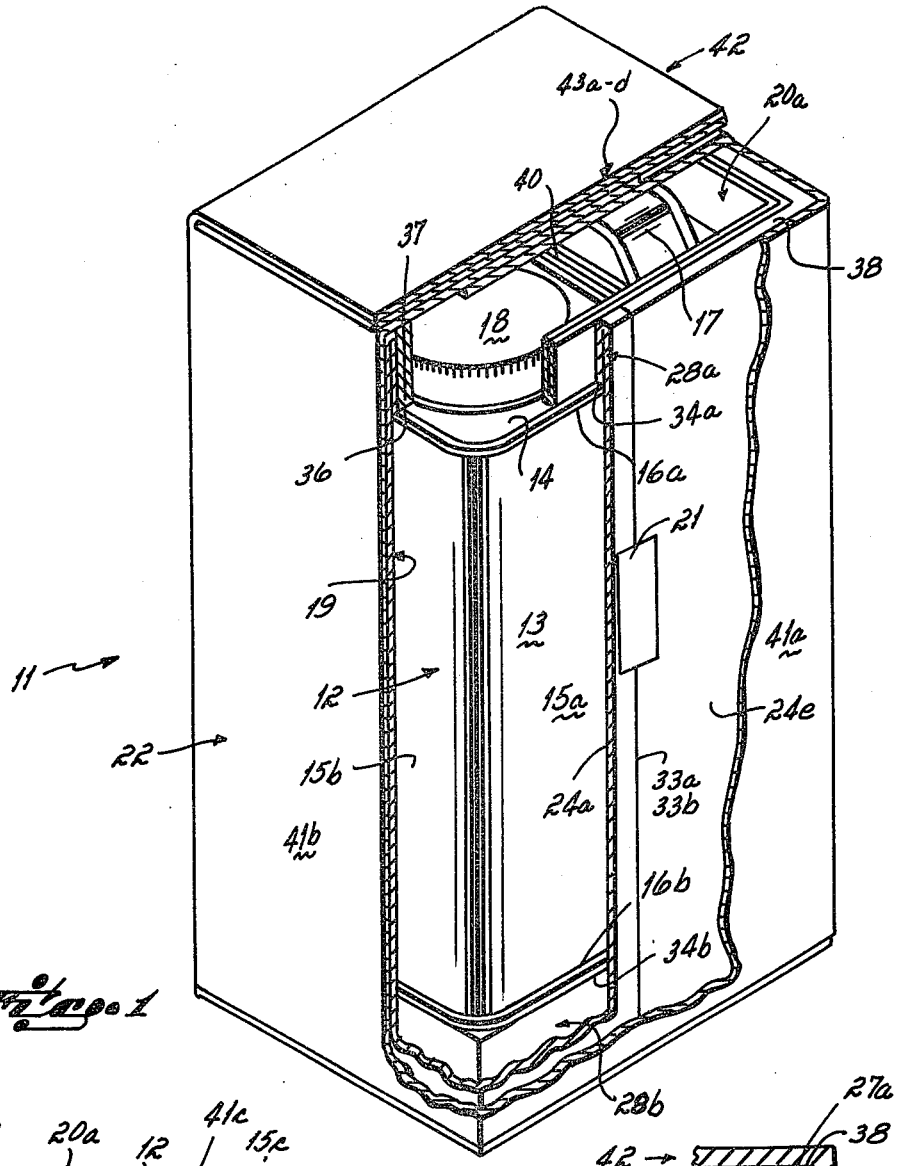
FIG. 1 is a perspective view of the present invention partially cut away.

As shown in FIG. 1, there is a protective package 11 formed from four cardboard elements designed to protect a can as shown in rectangular, parallelpiped metal can 12.

Figure 2:
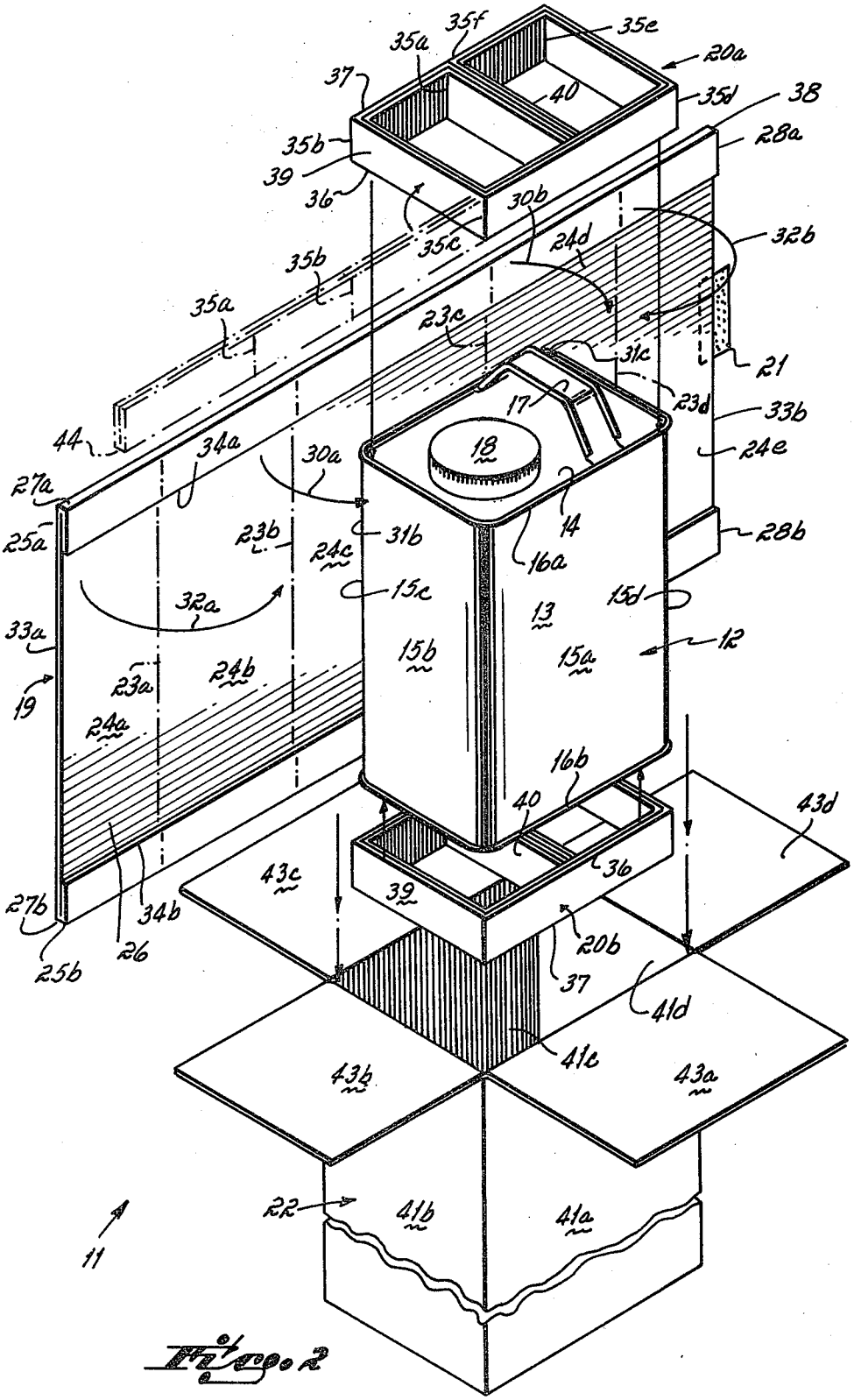
FIG. 2 is an exploded perspective view of the present invention depicting its method of application of the package of the present invention with a rectangular parallelpiped metal can.

These metal cans are generally three piece cans and comprise a can body 13, an upper end or lid 14, and a lower end or lid (not shown). The can body has a generally rectangular cross section and four generally rectangular walls 15*a*, 15*b*, 15*c* and 15*d*. The upper and lower lids are attached to either end of the can body by crimps 16*a* and 16*b* commonly referred to as chimes. The upper lid includes a raised metal handle 17 which extends across the top of the can and a pouring spout or opening sealed with a cap 18 as shown in FIG. 2.

The package, preferably formed from corrugated paperboard, is designed to protect this can 12. The package includes an inner liner or collar unit 19 which tightly wrap around the can and two reinforcing ribs or fillers 20*a* and 20*b* which lie at either end of can 12. An outer carton 22 surrounds and tightly holds together the inner liner against the metal can as well as the reinforcing ribs against the top and bottom of the can.

The inner liner 19 of the package is a rectangular corrugated cardboard blank which is separated by four vertical fold lines 23*a*, 23*b*, 23*c* and 23*d* into five panels 24*a*, 24*b*, 24*c*, 24*d* and 24*e*. The center panel 24*c* and the two panels 24*b*, 24*d* immediately adjacent the center panel, each correspond in area and dimension to walls 15*b*, 15*c*, 15*d*, respectively of the can. The two end panels 24*a*, 24*e* are each equal to one half the area of a fourth wall 15*a* of the can body.

The inner liner has upper and lower edge portions 27*a*, 27*b*, which project beyond the ends of the can. Upper and lower flanges 28*a*, 28*b* overlie the upper and lower edge portions. These flanges are formed by cutting a score in the corrugated board to form the flange and folding the flange upon the edge portion. Between the flanges 28*a*, 28*b* is a center section 26.

The inner shell 19 of the package is designed to wrap around the can 12. As shown in FIG. 2, one wall 15*c* of the can 12 aligns with the center panel 24*c* of the inner shell. The two panels 24*b* and 24*d* immediately adjacent the center panel fold inwardly against the two walls 15*b* and 15*d* of the can body as indicated by arrows 30*a* and 30*b*. Fold lines 23*b* and 23*c* align with two corners 31*b* and 31*c* of can 12. As indicated by arrows 32*a* and 32*b*, the end panels 24*a* and 24*e* of the inner shell fold at fold lines 23*a* and 23*d* upon the remaining wall 15*a* of the can. As designed, outer, vertical edges 33*a* and 33*b* of the inner liner should meet at approximately the center of this wall 15*a* and the inner liner should snuggly fit around and against the outer surface of the can body. The end panels are then joined together by a piece of tape 21. The plane of the corrugations of inner liner 19 should be parallel to the vertical axis of the can to provide strength to the package in the vertical direction.

The upper and lower flanges 28*a* and 28*b* of the inner shell are designed so that when the inner liner wraps around the metal can as shown in FIG. 2, interior edges 34*a* and 34*b* of the upper and lower flanges abut the upper and lower chimes 16*a* and 16*b* of can 12. These flanges hold the can in place, preventing the can from sliding within the inner shell and protect the chimes against damage.

Figure 3:
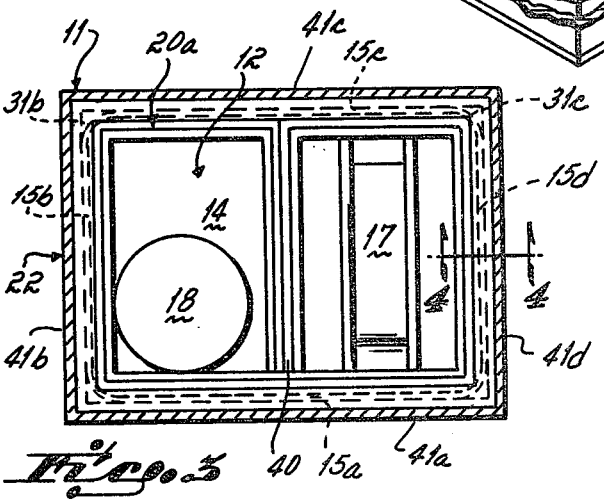
FIG. 3 is a top plan view partly in section.

The ribs or fillers 20*a* and 20*b* are positioned at either end of the can alongside the reinforcing flanges 28*a* and 28*b* of the inner liner. These ribs comprise thin elongated strips of cardboard folded over 180° along a horizontal fold line 44 to form an elongated two-layer thick strip (See FIG. 4). This strip folds at six vertical fold lines 35*a*, 35*b*, 35*c*, 35*d*, 35*e* and 35*f* to form a figure-eight configuration (See FIG. 3). The ribs include a middle leg 40 formed by two portions of this folded cardboard strip being folded together at the center of the "figure-eight". The outer dimensions of each rib is substantially the same as the inner dimensions of the flange so that when in place, it lies snuggly against the flange. The height of the rib is greater than the height of the flange by the height of the chime so that when the rib is positioned within the chime, its outer edge will be flush with the outer edge of the flange or liner.

Figure 4:
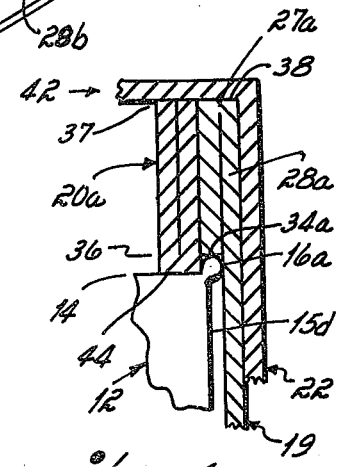
FIG. 4 is a cross section view taken at line 4—4 of FIG. 3.

Reinforcing ribs fit on the top and bottom of the can alongside the reinforcing rim with an inner edge 36 of each reinforcing rib abutting the can top or bottom, respectively (See FIG. 4). The outer edge 37 of the rib should lie level with an upper edge 38 of the reinforcing flange of the inner liner. On the top of the can body, the middle leg 40 of the rib should lie between the handle 17 and the cap 18 of the can. Although not depicted in the drawing, the reinforcing rib placed against the bottom of the can lies upon the bottom with this middle leg approximately along the center of the can bottom.

The outer carton is a rectangular parallelpiped corrugated cardboard package corresponding to the size of the exterior dimensions of the inner liner. The outer carton comprises four sides 41*a*, 41*b*, 41*c* and 41d. The inner dimension of the outer carton corresponds to the outer dimension of the inner liner so that the inner liner, when wrapped around a can, will fit snuggly within this outer carton. The outer carton also has a top 42 and a bottom (not shown). Since both are substantially the same, only the top is described. The top is formed from overlapping flaps 43*a*, 43*b*, 43*c* and 43*d* which fold over upon the top of the can to provide a means to seal the package. These flaps can be sealed by glue or tape.

The protective package of the present invention provides the requisite protection for metal cans being shipped. This protection provided by the protective package of the present invention substantially reduces the risk of rupture, even when metal cans containing viscous fluids are being shipped. More specifically, the inner liner protects the walls and corners of the can from sharp objects. As described, having the virtual edges 33*a* and 33*b* joining at the center of a can wall as opposed to meeting at a corner means that no corner is unprotected. The flanges hold the can top and bottom away from the top and bottom of the outer shell which provides added protection from sharp objects. The reinforcing ribs act to prevent the top and bottom of the can from buckling or oil canning.

The present invention in its broadest scope is not limited to protecting only rectangular cans. For example, the package of the present invention can also be used with circular cans with some modification of the package elements. To protect a circular can, it is contemplated that an octagonal inner liner would surround the cylindrical surface of the can and contact it at eight lines spaced around the circumference. The inner liner will have flanges which engage the chimes of the can. A square rib member, formed of two double thickness isosceles triangles, will be mounted at both ends of the can to protect the ends of the can. The ribs will be disposed within the confines of the flanges of the octagonal liner. This assembly will be positioned in a carton having a square cross section.

Accordingly, a can encased in such a package is protected from contact with sharp objects and is also protected from the internal forces created when the fluid within the can tends to press against the top or bottom of the can. Thus, this package provides a means to safely ship viscous fluids held in metal cans.

Having thus described my invention, I claim:

1. In combination with a generally rectangular metallic container having peripheral chimes on its upper and lower surfaces, a protective package comprising an inner liner surrounding said container and having upper and lower edge portions extending beyond the chimes at the upper and lower ends of said container;

inner flanges secured to said upper and lower edge portions and engageable with the edges of said chimes at respective ends of said container;

a separate filler member forming a generally rectangular rib disposed within each chime of said container adapted to support the end walls of said container against internal pressure and to maintain said flanges engaged with the edges of said chimes;

and a rectangular outer carton surrounding said liner and said ribs at the end of said container wherein the inner dimensions of said outer carton correspond to the exterior dimensions of said inner liner.

2. A four-piece package as claimed in claim 1 wherein said generally rectangular ribs comprise two-layer thick sections of corrugated board folded at a plurality of vertical fold lines to form a figure-eight configuration.

3. A protective package as claimed in claim 1 wherein said metallic container includes a handle and a spout and said upper reinforcing rib includes a middle leg disposed between said handle and said spout.

4. A protective package as claimed in claim 1 wherein said inner liner further comprises a generally rectangular piece of cardboard comprising five generally rectangular panels, three of said panels corresponding in area to three sides of said metallic container and two of said panels corresponding to approximately one half the area of a fourth side of said metallic container.

5. A four-piece package for protecting a rectangular parallelpiped article having a top and a bottom and four sides comprising:

an inner liner having upper and lower edge portions, upper and lower flanges disposed along the upper and lower edge portions of said inner liner and engageable with upper and lower edges of said article, a pair of separate filler members forming upper and lower reinforcing ribs disposed within and lying against said upper and lower flanges respectively, and adapted to maintain said flanges engaged with said upper and lower edges, and an outer carton wrapped about said inner liner and said ribs wherein the inner dimensions of said outer carton correspond to the exterior dimensions of said inner liner, whereby said package is adapted to receive a container with said ribs and flanges engaging upper and lower ends of said container and with the inner liner engaging the walls of said container.

6. A four-piece package as claimed in claim 5 wherein said inner liner and said reinforcing ribs comprise folded pieces of corrugated paperboard.

7. A package as claimed in claim 5 wherein said liner includes upper and lower panels and wherein said upper and lower flanges comprise said upper and lower panels folded inwardly upon said inner liner.

8. A four-piece package as claimed in claim 5 wherein said upper and said lower reinforcing ribs comprise two-layer thick sections of corrugated board folded at a plurality of vertical fold lines to form a figure-eight configuration.

9. A four-piece package as claimed in claim 8 wherein said upper reinforcing rib has a middle leg.

10. In combination with a generally rectangular parallelpiped article having a top including a handle and a spout, a bottom and four sides, a four-piece package comprising:

an inner liner, said inner liner comprising a generally rectangular piece of corrugated board separated into three inner and two outer rectangular panels and including upper and lower reinforcing flanges wherein the dimensions of said three inner panels correspond to the dimensions of three sides of said parallelpiped article and the combined dimensions of said two outer panels correspond to the dimensions of a fourth side of said parallelpiped article, said inner liner surrounding said rectangular parallelpiped article and said upper and lower reinforcing flanges, respectively, abutting peripheral edges of the top and bottom of said generally parallelpiped article, a pair of separate filler members forming an upper and a lower reinforcing rib, said ribs each comprising a two-layer thick section of corrugated board folded at a plurality of vertical fold lines to form a figure-eight configuration, said ribs including a middle leg, said upper and lower reinforcing ribs are disposed against the top and bottom of said parellelpiped article with the middle leg of said upper reinforcing rib positioned between said handle and said spout, and maintaining said flanges abutted against said edges, and an outer carton adapted to receive said parallelpiped article, when surrounded by said inner liner and contacted by said upper and lower reinforcing ribs wherein the inner dimensions of said outer carton correspond to the exterior dimensions of said inner liner.

* * * * *